US008166703B2

(12) United States Patent
Driscoll

(10) Patent No.: US 8,166,703 B2
(45) Date of Patent: May 1, 2012

(54) CONICAL CONTAINER

(76) Inventor: Daniel G. Driscoll, Atlanta, GA (US)

( * ) Notice: Subject to any disclaimer, the term of this patent is extended or adjusted under 35 U.S.C. 154(b) by 427 days.

(21) Appl. No.: 12/484,001

(22) Filed: Jun. 12, 2009

(65) Prior Publication Data

US 2009/0307971 A1 Dec. 17, 2009

Related U.S. Application Data

(60) Provisional application No. 61/061,015, filed on Jun. 12, 2008.

(51) Int. Cl.
*A47G 7/00* (2006.01)

(52) U.S. Cl. ..... 47/41.12; 47/41.01

(58) Field of Classification Search ..... 47/41.01, 47/41.11, 66, 66.7
See application file for complete search history.

(56) References Cited

U.S. PATENT DOCUMENTS

| | | | | | |
|---|---|---|---|---|---|
| 243,781 | A | | 7/1881 | Koch | |
| 903,227 | A | * | 11/1908 | Pruden | 47/41.13 |
| 954,440 | A | * | 4/1910 | Klemm | 47/79 |
| 1,491,925 | A | * | 4/1924 | Rosenwald | 47/41.11 |
| 2,589,967 | A | | 3/1952 | Sawyer | |
| 2,826,789 | A | * | 3/1958 | Etling | 49/459 |
| 2,826,864 | A | * | 3/1958 | Bradley | 47/41.11 |
| 3,131,510 | A | * | 5/1964 | Engstrom | 47/41.01 |
| 3,157,335 | A | * | 11/1964 | Maier | 229/400 |
| 3,158,524 | A | * | 11/1964 | Tong | 206/423 |
| 3,183,624 | A | * | 5/1965 | Swett | 47/41.11 |
| 3,245,175 | A | * | 4/1966 | Klingberg | 47/41.13 |
| 3,431,706 | A | | 3/1969 | Stuck | |
| 3,768,202 | A | * | 10/1973 | Wheelock | 47/41.13 |
| 4,040,207 | A | * | 8/1977 | Lancaster | 47/80 |
| 4,065,877 | A | | 1/1978 | Kelley | |
| 4,113,094 | A | * | 9/1978 | Collin | 206/423 |
| 4,461,118 | A | * | 7/1984 | Fertig | 47/41.01 |
| 5,183,280 | A | | 2/1993 | Gresch | |
| 5,282,335 | A | * | 2/1994 | Holtkamp, Jr. | 47/81 |
| 5,353,546 | A | * | 10/1994 | Bock | 47/66.6 |
| 6,311,862 | B1 | | 11/2001 | Barnes | |
| 6,588,654 | B2 | * | 7/2003 | Nakashima | 229/402 |
| 7,024,818 | B2 | * | 4/2006 | Maniscalco et al. | 47/65.6 |
| D564,938 | S | * | 3/2008 | Schissler | D11/147 |
| 2003/0150158 | A1 | | 8/2003 | Wright | |
| 2005/0138861 | A1 | | 6/2005 | O'Connor | |
| 2005/0210741 | A1 | * | 9/2005 | Feddern | 47/41.01 |
| 2007/0029276 | A1 | | 2/2007 | Clare | |
| 2009/0265984 | A1 | * | 10/2009 | Weder | 47/66.7 |
| 2009/0307971 | A1 | * | 12/2009 | Driscoll | 47/41.13 |

* cited by examiner

*Primary Examiner* — Frank T Palo
(74) *Attorney, Agent, or Firm* — Woodcock Washburn LLP

(57) ABSTRACT

A conical container that is stable includes a cup adapted to contain liquid and/or one or more selected item(s) and a frustoconical skirt depending therefrom. The container may further include a plurality of removable and interchangeable inserts operable with the cup and/or one or more tray operable with the skirt. The container may advantageously be used as a vase for an arrangement of fresh cut flowers, and may optionally be converted for use with one or more additional selected item.

18 Claims, 7 Drawing Sheets

CONICAL CONTAINER

CROSS-REFERENCE AND PRIORITY CLAIM TO RELATED APPLICATIONS

The present U.S. non-provisional patent application is related to, and hereby claims priority to, and the full benefit of provisional patent application Ser. No. 61/061,015, filed on Jun. 12, 2008, incorporated herein by reference.

TECHNICAL FIELD

The present disclosure relates generally to containers, and, more particularly, to a stable conical container for articles, particularly for cut flower arrangements.

BACKGROUND OF THE INVENTION

For aesthetic reasons, many containers, such as vases, flower pots, candle holders, drinking glasses, umbrella stands, or the like, are formed having a shape that is inherently unstable, or are easily tipped or knocked over, either unintentionally by an individual or by an animal, or by wind or other environmental condition. Especially where fragile items or liquid is contained, or where the container itself is fragile, such instability frequently results in damage when the container is tipped or knocked over, by breaking and/or by staining or wetting. Thus, it is clear that there is an unmet need for a stable container for one or more article(s) and/or liquid that resists tipping and that is aesthetically pleasing.

BRIEF SUMMARY OF THE INVENTION

Briefly described, in a preferred embodiment, the conical container of the present disclosure overcomes the above-mentioned disadvantages and meets the recognized need for such a stable and aesthetically pleasing container by providing a flower vase including a skirt having a base and an open top and defining a longitudinal axis extending from the base to the open top, wherein the base extends further from the longitudinal axis than the top in a plurality of directions, and a cup disposed within the skirt.

More specifically, the skirt is preferably frustoconical and preferably includes a lower edge at the base and an upper edge at the open top. The lower edge preferably provides a closed-loop perimeter defining a two-dimensional shape within a plane of the base. The skirt preferably extends from the lower edge to the upper edge, which preferably provides a closed-loop perimeter defining a two-dimensional shape within a plane of the top. The two-dimensional shapes of the base and the top may be selected from any desired shape, such as round shapes, including ovals, circles, and rounded polygons, or the like, and polygonal shapes, such as triangles, rectangles, pentagons, hexagons, etc. and the two-dimensional shapes may be different from one another. Optionally, the base may further include a solid bottom disposed within and engaging the lower edge of the skirt, a high friction coating and/or treatment to resist sliding, or both.

The cup preferably includes an inner wall that is operable with at least a portion of the upper edge of the skirt. The inner wall is preferably formed as a cone or a frustoconical member and a bottom, whereby the cup is capable of containing water or other liquid without substantial leakage, and whereby the cup is capable of containing selected items, such as fresh or artificial flowers. The wall, the cup, and the skirt may be integrally formed, or may be formed separately and joined via a suitable process. The wall is preferably adapted to receive and retain a removable frog insert, such as a round disc having an array of openings formed therethrough. As will be understood by those ordinarily skilled in the art, the openings may be round, square, rectangular, or may have other shapes, and may or may not be uniform in size and/or shape. The frog is preferably engageable with the wall proximate a medial portion thereof, whereby the frog is preferably not visible from the outside of the vase.

In order to facilitate gripping the vase, the skirt may optionally include one or more gripping device, such as an equatorial channel or depression, a vertical ridge, a horizontal ridge, an aperture, a notch, or the like, or combinations thereof. Preferably, the skirt includes a plurality of round apertures formed through a medial portion thereof, and generally equally spaced thereabout, whereby a user may insert a finger and thumb through selected apertures to securely grasp the vase.

Accordingly, a feature and advantage of the container is its ability to provide stability for one or more article contained therein, especially for one or more flower.

Another feature and advantage of the container is its ability to provide an aesthetically-pleasing container that includes at least one gripping device formed in or on an outer surface thereof to facilitate secure carriage of the container.

These and other features and advantages of the present invention will become more apparent to those ordinarily skilled in the art after reading the following Detailed Description of the Invention and Claims in light of the accompanying drawing Figures.

BRIEF DESCRIPTION OF THE DRAWINGS

Accordingly, the present invention will be understood best through consideration of, and with reference to, the following drawings, viewed in conjunction with the Detailed Description of the Invention referring thereto, in which like reference numbers throughout the various drawings designate like structure, and in which.

Figure 1:
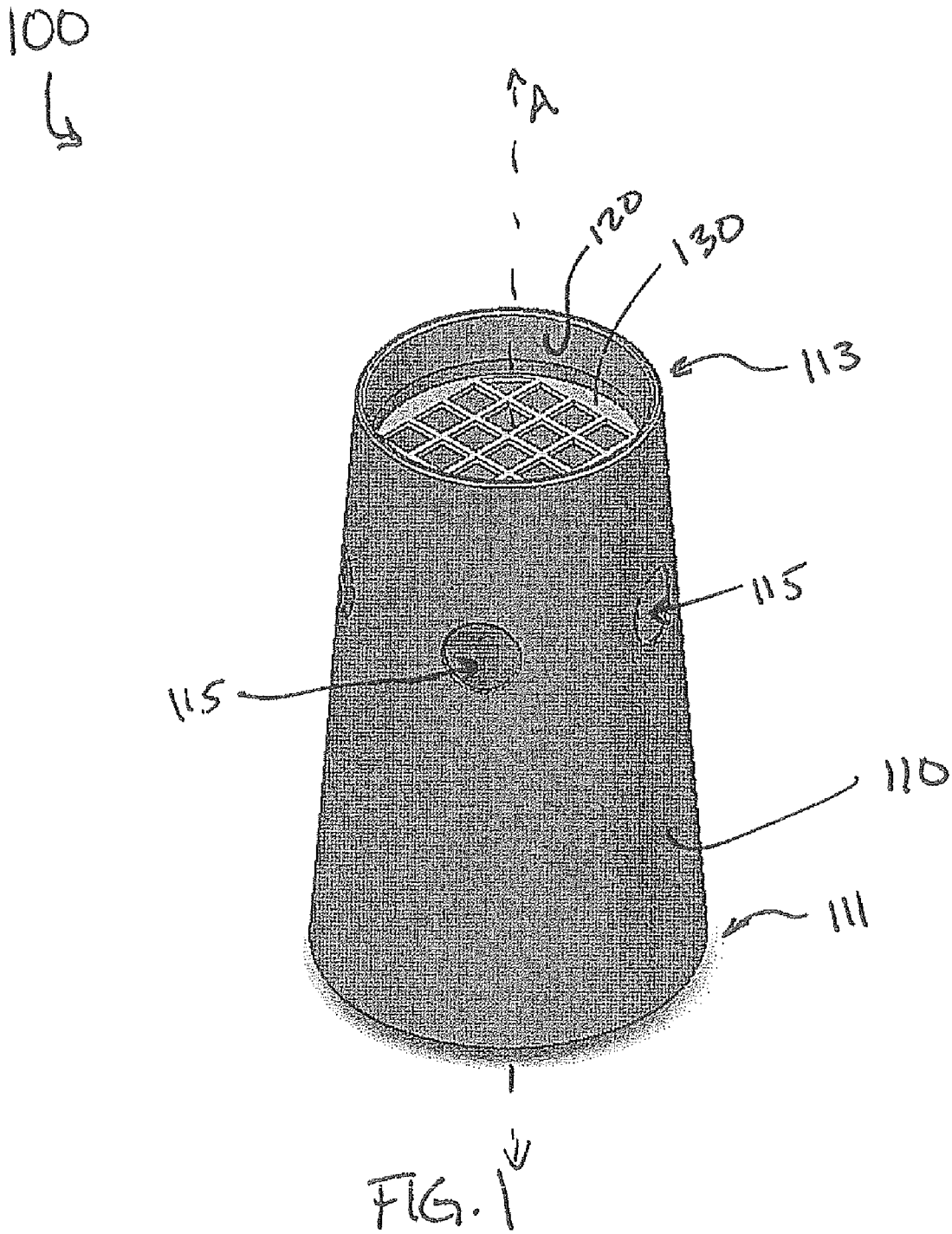
FIG. 1 is a front perspective view of the container according to an exemplary configuration.
Figure 2:
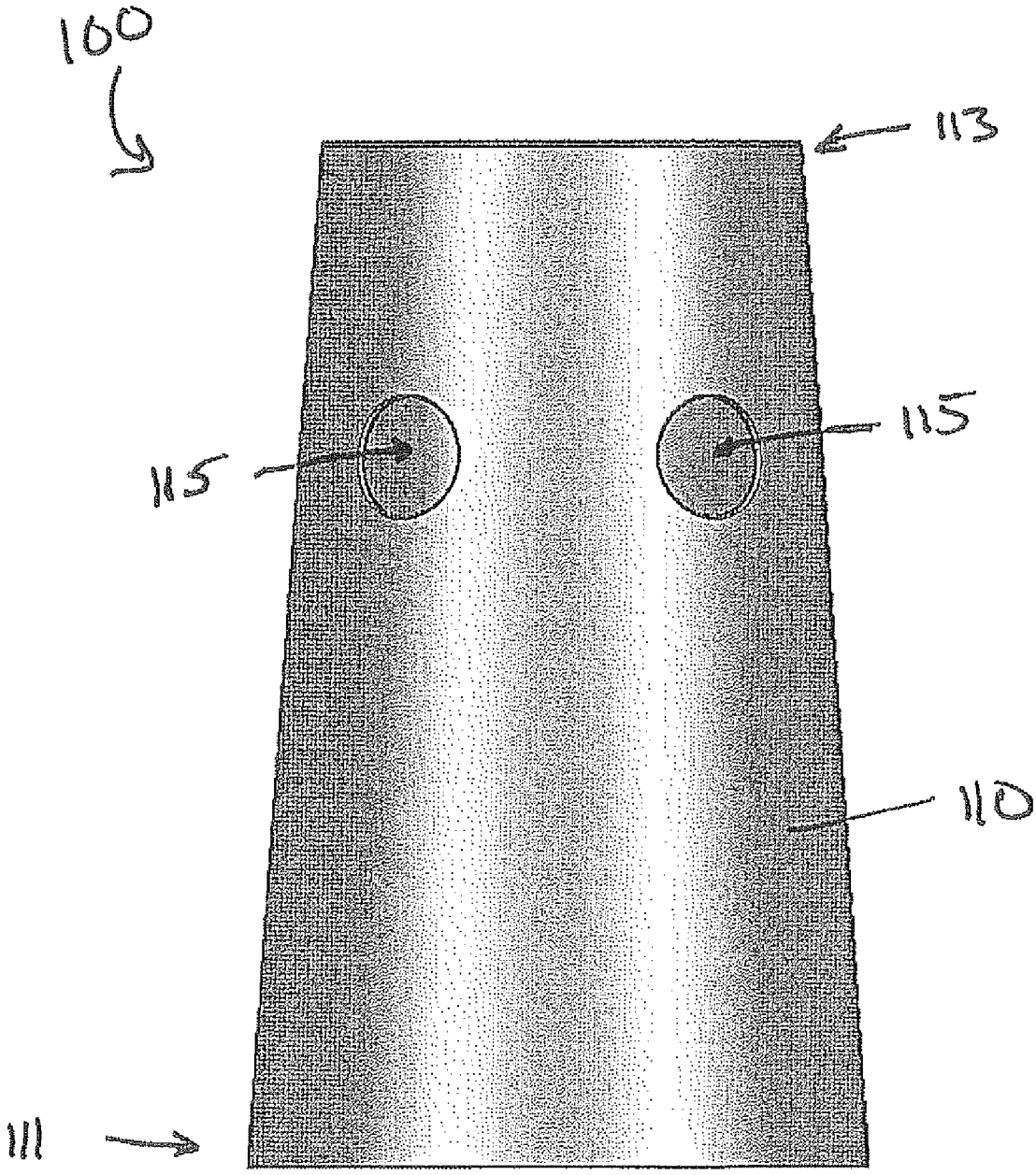
FIG. 2 is a front view of the container of FIG. 1.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing various embodiments of the container of the present disclosure illustrated in the drawings, specific terminology is employed for the sake of clarity. The claimed invention, however, is not intended to be limited to the specific terminology so selected, and it is to be understood that each specific element includes all technical equivalents that operate in a similar manner to accomplish a similar purpose.

As shown in FIGS. 1-5, container 100 may preferably be configured as a flower vase in which arrangements of fresh cut flowers may be displayed and in which water for such flowers may be contained. Container 100 preferably includes skirt 110 and cup 120.

Skirt 110 is preferably formed as an outer frustoconical sidewall having base 111 and top 113, and extending generally along axis A. Skirt 110 may additionally include a plurality of apertures 115, such as five apertures, formed in a medial portion of skirt 110 and evenly spaced therearound. Apertures 115 may be used to facilitate gripping and carrying container 110 by insertion of a user's finger and thumb through selected ones of apertures 115. Apertures 115 may be formed by removing a portion of the material of skirt 110, by molding, or by bending a flap of material to allow finger access. Apertures 115 are preferably circular or other round shape, but may be polygonal if desired for improved grip and/or for aesthetics.

Figure 3:
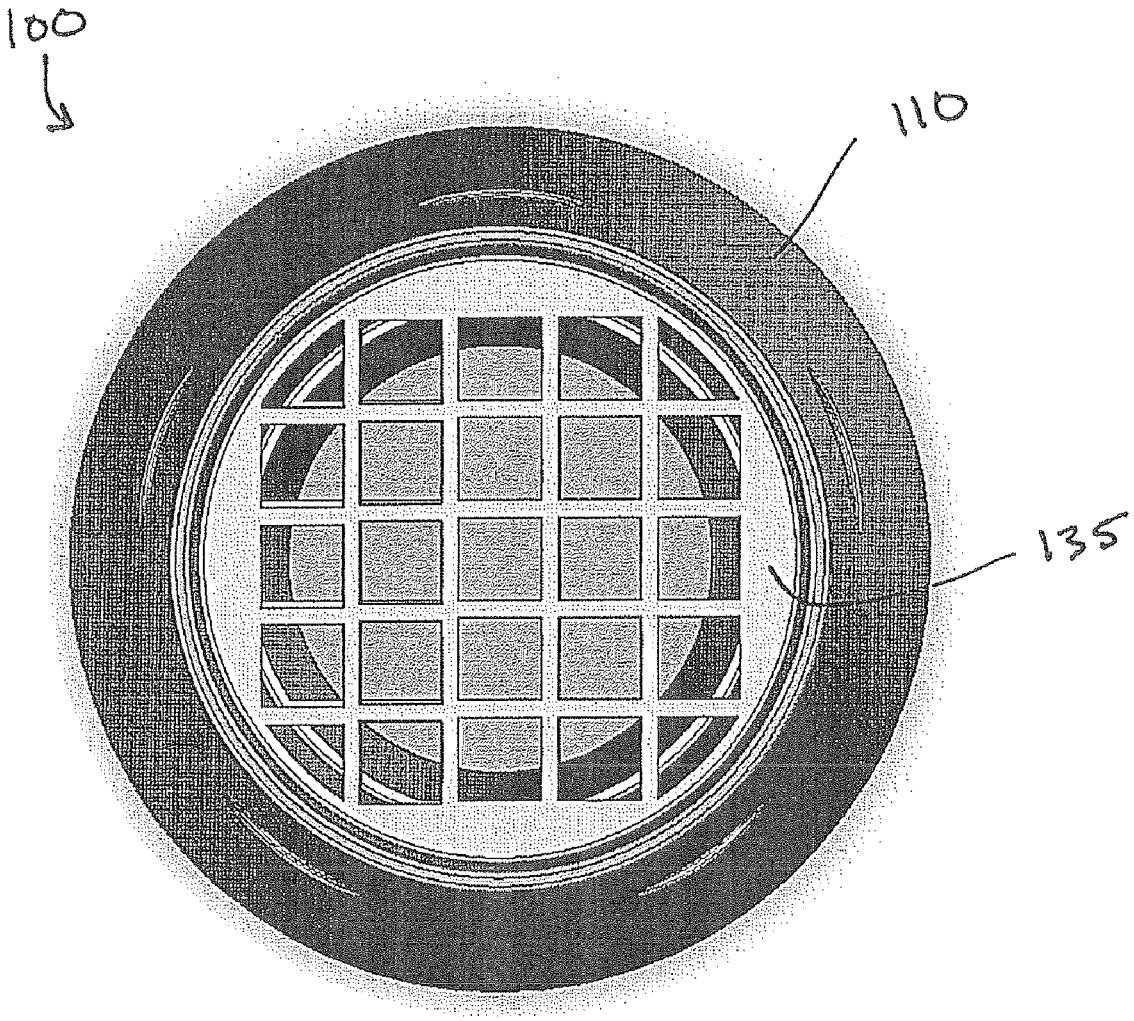
FIG. 3 is a top view of the container of FIG. 1.
Figure 4:
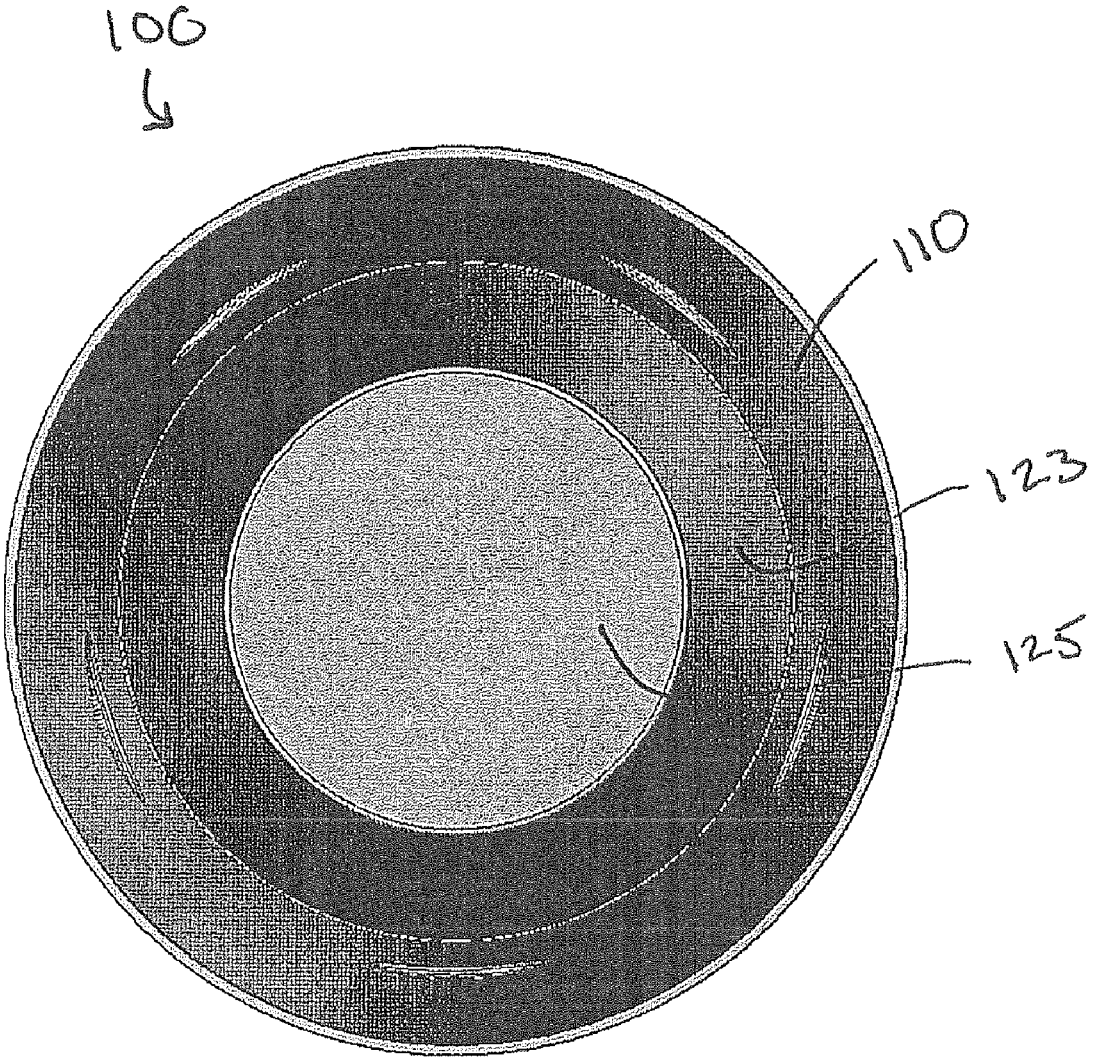
FIG. 4 is a bottom view of the container of FIG. 1.

As shown, particularly in FIGS. 3 and 4, base 111 and top 113 may be formed having circular cross-sectional shapes. Alternatively, however, other round or rounded cross-sectional shapes, such as oval or rounded polygonal shapes may be included, or polygonal shapes may be included. Furthermore, the cross-sectional shape of base 111 and top 113 may be different, as desired for aesthetics and/or function. Optionally, skirt 110, or a selected portion thereof, such as proximate base 111, may include a high-friction coating and/or treatment, such as a rubber coating. Such coating and/or treatment preferably resists slippage, whether to improve a user's grip of skirt 110 or to reduce sliding of container 100 over a surface on which it is disposed. As a further option, a bottom (not shown) may be included extending over base 111, whereby a bottom surface area of container 100 may be increased, i.e. may be greater than the surface area of a bottom edge of skirt 110.

Cup 120 is preferably operable with skirt 110 proximate top 113 of skirt 110 and preferably includes wall 123 adapted to contain one or more article and/or a liquid, and adapted to receive one or more insert 130. Specifically, wall 123 may be a cone, whereby wall 123 terminates in a point at a lower edge thereof such that liquid may be contained therein, or, alternatively, and as shown, cup 120 may include bottom 125 operable with a frustoconical wall 123. As will be understood by those ordinarily skilled in the art, such frustoconical skirt 110 and conical or frustoconical cup 120 preferably allow vase 100 to be stacked in a nested arrangement with one or more additional vase 100.

Wall 123 preferably includes at least one circumferential groove or ledge, such as grooves or ledges 127 and 129 formed in an inner surface of wall 123, whereby a corresponding insert 130, such as gridded inserts 133 and 135, which may be advantageously used as frogs for cut or artificial flower arrangement, may be removably engaged with, and retained in engagement with, wall 123, such as via friction and/or snap fit. Wall 123 is preferably formed having a circular cross-sectional shape, and inserts 133 and 135 are preferably formed as circular discs, whereby rotational orientation of inserts 133 and 135 does not affect engagement with a respective one of grooves or ledges 127 and 129. Furthermore, such circular cross-sectional shape preferably prevents substantial passage of insert 133 past groove or ledge 127 and preferably prevents substantial passage of insert 135 past groove or ledge 129. As will be understood by those ordinarily skilled in the art, other securing mechanisms may be employed to retain inserts 130 at a desired position within cup 120. For example, a circumferential ridge may be included at a desired location of wall 123 and may engage a corresponding groove in an edge of an insert. Additionally, inserts 130 may optionally be formed to include an angled edge that is adapted to mate generally flush with an angle of wall 123.

Figure 5:
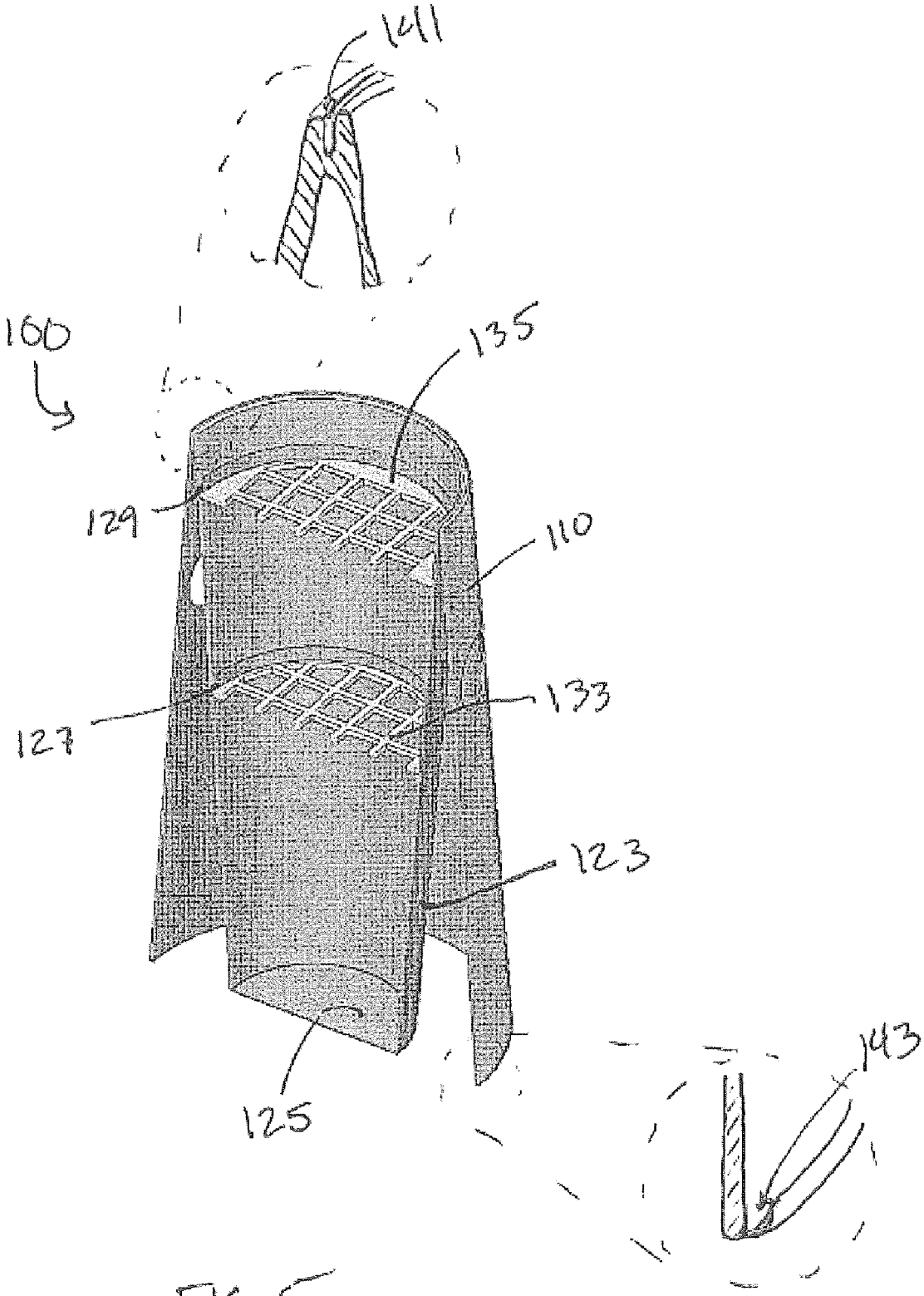
FIG. 5 is a cross-sectional perspective view of the container of FIG. 1.

Optionally, and as shown in the detail views of FIG. 5, container 100 may include one or more gutter adapted to catch and retain spilled liquid, or the like. Specifically, channel 141 may be formed within an upper edge of container 100 proximate top 113. Additionally or alternatively, channel 143 may be formed on an outer surface of skirt 110, such as proximate base 111.

Figure 6:
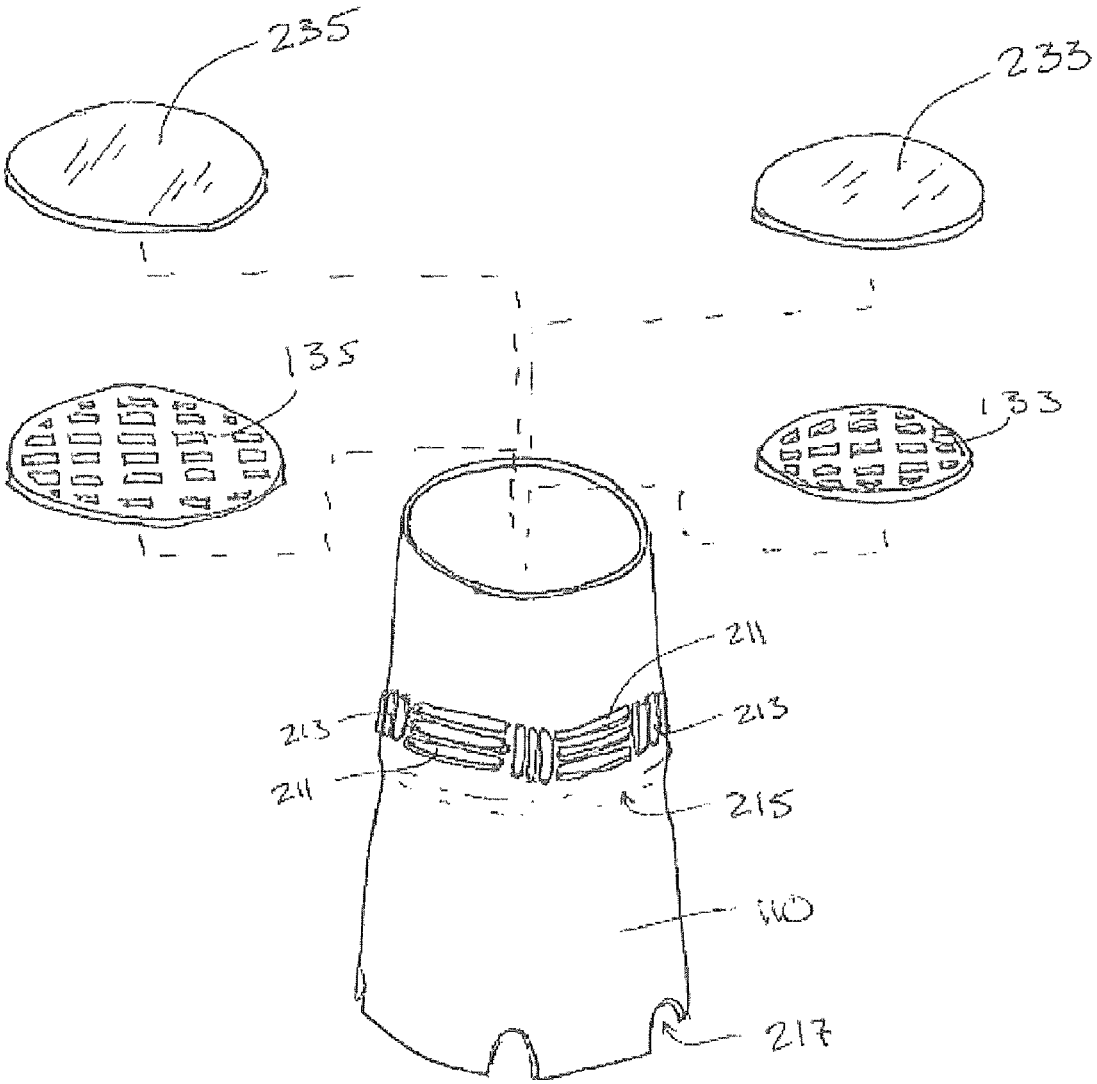
FIG. 6 is an exploded perspective view of a container according to an alternate configuration.

Now referring to FIG. 6, skirt 110 may optionally include additional or alternative gripping device in addition to, or in place of, apertures 115. For example, horizontal ridges 211 and/or vertical ridges 213 may be formed over a medial portion of skirt 110. Similarly, depression or channel 215 formed over at least a portion thereof for facilitating gripping by a user. For example, depression or channel 215 may be formed as an equatorial or medial waist or local region of smallest cross-sectional dimension extending completely around skirt 110. Alternatively, depression or channel 215 may be formed as one or more divots, dimples, or the like, adapted to receive a user's finger tip(s). The curvature of depression or channel 215 preferably increases a frictional engagement force with a user's hand or fingers to make grasping container 100 more secure. If included, depression or channel 215 is preferably generally shallow, such as carved into skirt 110, such that an inner surface of skirt 110 may be generally straight in a direction from base 111 to top 113. Furthermore, notches 217 may be included proximate base 111.

With continued reference to FIG. 6, system 200 may include container 100 and a plurality of removable and interchangeable inserts, such as gridded inserts 133 and 135, and corresponding solid inserts 233 and 235 adapted to engage grooves 127 and 129, respectively. Thus, a number and style of inserts selected for use with container 100 may be selected as desired according to a preference of a user, according to requirements for a selected use or article selected for storage in container 100, or the like. As will be understood by those ordinarily skilled in the art, while solid and rectangular gridded inserts have been illustrated, virtually any configuration of insert may be included, such as an insert with a plurality of round, circular, polygonal or other shape apertures, or combinations thereof, an insert with a single aperture formed therethrough, a mesh insert, a slotted insert, an insert carrying prongs or spikes, a foam insert, or the like.

Figure 7:
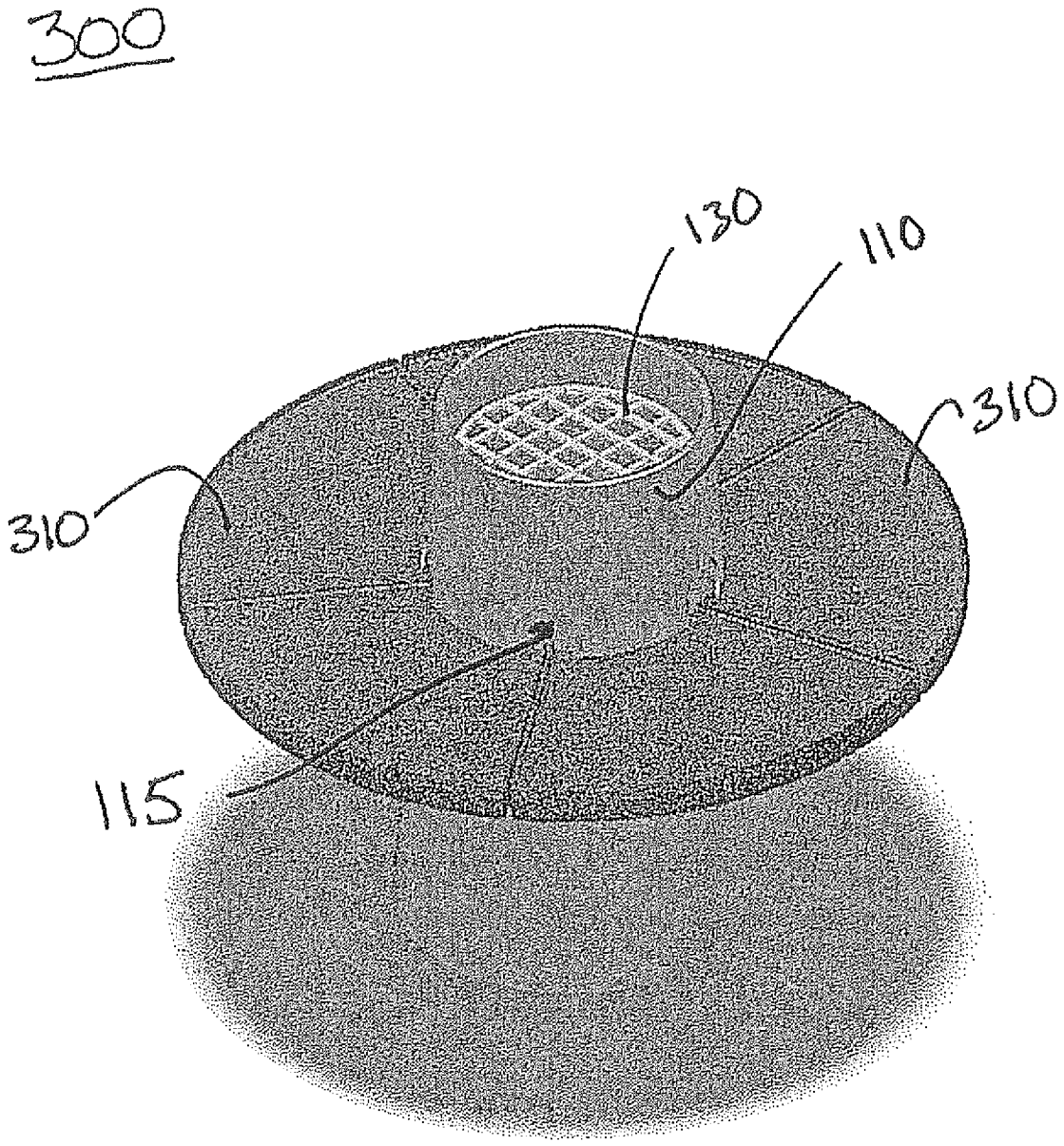
FIG. 7 is a perspective view of a system including the container of FIG. 1.

Now referring to FIG. 7, system 300 preferably includes container 100 and a plurality of removably-engageable members 310. As illustrated, five members 310 may be included, and each member 310 may be formed as a segment of a disc. Members 310 may be adapted to removably engage container 100, such as via one or more corresponding aperture 115 and/or one or more adjacent one(s) of members 310. Specifically, and as shown, each member 310 may be adapted to engage two adjacent ones of apertures 115 at respective ends of member 130. Thus, when all five members 310 are engaged with container 100, members 310 preferably encircle container 100 proximate a medial portion of skirt 110, and each one of apertures 115 provides a point of engagement for two members 310. Optionally, and preferably when one or more member(s) 310 completely encircle(s) container 100, additional apertures 115 may be provided above or below members 310 for use in gripping container 100 without interfering with items placed on member(s) 310.

As will be understood by those ordinarily skilled in the art, members 310 may be formed having alternate shapes, may be disposed in alternate locations, and may be engageable with one another and/or with container 100 via any suitable structure, such as one or more hook(s), pin(s), ridge(s) and slot(s), hanger(s), collapsible or flexible prong(s), or the like. Additionally, members 310 may be formed as greater or smaller segments of a disc, and may be adapted to engage container 100 at different areas along axis A, whereby two or more complete rings may be formed around container 100. Additionally, while only a single ring-shaped member 310 may be included, and may be engaged with container 100 by sliding over top 113, a plurality of members 310 formed as ring segments are preferred whereby members 310 may individually be engaged with and/or removed from engagement with container 100 without disturbing an arrangement of flowers contained therein, or the like.

In use, container 100 may be used as a vase, wherein gridded inserts 133 and 135, or other selected inserts, may be engaged with grooves 127 and 129 and one or more flower, such as a fresh cut flower, may be disposed within container cup 120 of container 100. Particularly, a plurality of flowers may preferably be engaged with selected respective apertures of inserts 133 and 135 to create a flower arrangement. Inserts 133 and 135 preferably retain such flowers in the selected arrangement, and prevent substantial movement of the flowers. Water may be added to cup 120 to feed the flowers. Container 100 may be lifted and moved via grasping skirt 110, such as via apertures 115, or other gripping structure, whereby container 100 may be disposed in a desired location. Skirt 110 preferably provides a stable base for container 100 and substantially resists tipping. As flowers die, become wilted, or the like, such unappealing flowers may be selectively removed while leaving fresh flowers within container 100 and while not disturbing the remainder of the arrangement. When all of the flowers have been removed, container 100 may be recycled or put in the trash.

Alternatively, however, container 100 may be used for other purposes when the flowers have been removed. For example, pens, pencils, or the like may be stored therein and separated by gridded inserts 133 and 135. Alternatively, one or both of inserts 133 and 135 may be removed and container 100 may be used to contain other items, such as a candle. If a selected candle is tall, no inserts may be used; if smaller candles, such as votives or tea lights are to be used, a selected one of solid inserts 233 and 235 may be engaged with a corresponding one of grooves 127 and 129 to provide a resting surface at a desired distance from bottom 125.

According to an exemplary method of use, flowers may preferably be arranged within container 100 by a retailer, and may be delivered to a customer, or to another selected recipient, in container 100. If desired, additional items may be delivered with the flowers as a package, such as candies, cookies, scented oil or other fragrant substance, or the like. Such additional items may preferably be placed on one or more of members 310 used as a tray. Alternatively a single tray may be engaged with container 100 for such purpose. Thus, the flowers and candies, cookies, fragrant substance, or the like, may be delivered and/or presented as a combined gift. If desired, such as when the additional items are used or consumed, members 310 may be removed from container 100.

Having thus described exemplary embodiments of the present invention, it should be noted by those skilled in the art that the within disclosures are exemplary only and that various other alternatives, adaptations, modifications, and/or combinations may be made within the scope and spirit thereof. Particularly, it should be noted that teachings or other discussion made with reference to one embodiment, including discussions of alternative structures, uses, functions, or the like, are intended to likewise apply to other embodiments, whether specifically illustrated and/or described or not, and such teachings are not necessarily intended to apply solely to the embodiment(s) in reference to which they are made. Additionally, and as will be understood by those ordinarily skilled in the art, the structures of the present disclosure may be formed of any suitable material by any suitable process, including, but not limited to, plastic, rubber, glass, metal, wood, composites, or the like. Accordingly, the present invention is not limited to the specific embodiments as illustrated herein, but is only limited by the following claims.

What is claimed is at least:

1. A container comprising:

a frustoconical skirt tapering from a base to a top;

a cup disposed within said frustoconical skirt and adapted to contain a liquid; and a plurality of removable and interchangeable inserts operable to engage a portion of said cup, wherein each said insert is engageable with a corresponding grooved formed in an inner surface of said cup.

2. The container of claim 1, wherein said insert comprises a plurality of apertures formed therein.

3. The container of claim 1, wherein said at least one insert comprises two gridded inserts removably operable with said cup, and wherein apertures of said two gridded inserts are aligned in registration when said gridded inserts are engaged with said cup.

4. The container of claim 1, wherein said skirt comprises a gripping device.

5. The container of claim 1, wherein said skirt comprises a plurality of apertures formed therethrough around a medial portion of said skirt.

6. The container of claim 1, further comprising at least one channel adapted to collect liquid, said at least one channel being disposed on at least one of an upper edge of said skirt and an outer surface of said skirt.

7. The container of claim 1, wherein said cup comprises a frustoconical wall and a flat bottom.

8. A container system comprising:

a cup operable to contain at least one of a liquid and a selected item;

a frustoconical skirt depending from a top of said cup;

a plurality of removable and interchangeable inserts operable to engage a portion of said cup; and at least one tray removably operable with said skirt.

9. The system of claim 8, wherein said skirt comprises a plurality of apertures adapted to receive a user's finger for gripping.

10. The system of claim 9, wherein said at least one tray is operable with said skirt via engagement with at least one of said plurality of apertures of said skirt.

11. The system of claim 8, wherein said plurality of removable and interchangeable inserts comprises at least one solid insert and at least one apertured insert.

12. The system of claim 8, wherein each of said plurality of removable and interchangeable inserts is engageable with a corresponding groove formed in an inner surface of said cup.

13. A method of distributing flowers and at least one additional selected item, said method comprising the steps of:

providing a container system comprising a cup operable to contain at least one of a liquid and a flower, a frustoconical skirt depending from a top of said cup, a plurality of removable and interchangeable inserts operable to engage a portion of said cup, and a tray removably operable with said skirt, arranging at least one flower in said cup;

disposing at least one additional selected item on said tray; and distributing the at least one flower and the at least one additional selected item to a selected recipient.

14. The method of claim 13, wherein said step of arranging comprises the step of disposing at least a portion of a flower through an aperture of an insert, the insert being disposed proximate a medial portion of the cup.

15. The method of claim 13, further comprising the step of removing the tray from the container system.

16. The method of claim 13, further comprising at least one step selected from the group consisting of removing an apertured insert from an interior of the cup and engaging an insert with an interior of the cup.

17. The method of claim 16, further comprising the step of disposing at least one second selected item on the tray.

18. The method of claim 13, wherein the at least one selected item is selected from the group consisting of candies and baked goods.

* * * * *